US008960478B2

(12) United States Patent
Crye

(10) Patent No.: US 8,960,478 B2
(45) Date of Patent: Feb. 24, 2015

(54) FOOD AND CONDIMENT CONTAINER

(76) Inventor: Caleb C. Crye, Brooklyn, NY (US)

( * ) Notice: Subject to any disclaimer, the term of this patent is extended or adjusted under 35 U.S.C. 154(b) by 201 days.

(21) Appl. No.: 13/504,216

(22) PCT Filed: Oct. 28, 2010

(86) PCT No.: PCT/US2010/054435

§ 371 (c)(1),
(2), (4) Date: Apr. 26, 2012

(87) PCT Pub. No.: WO2011/053684

PCT Pub. Date: May 5, 2011

(65) Prior Publication Data

US 2012/0205372 A1 Aug. 16, 2012

Related U.S. Application Data

(60) Provisional application No. 61/280,021, filed on Oct. 29, 2009.

(51) Int. Cl.
*B65D 5/48* (2006.01)
*B65D 21/02* (2006.01)

(52) U.S. Cl.
CPC *B65D 5/48* (2013.01); *B65D 21/02* (2013.01); *Y10S 229/904* (2013.01); *Y10S 229/906* (2013.01)
USPC ..... 220/503; 220/23.2; 220/23.83; 220/23.4; 229/110; 229/117.01; 229/120.18; 229/120.21; 229/400; 229/904; 229/906; 383/38; 426/120; 206/541

(58) Field of Classification Search
CPC ..... B65D 5/48; B65D 21/02; B65D 31/12
USPC ..... 220/23.2, 23.4, 23.83, 503; 229/120.18, 229/120.21, 400, 904, 906, 110, 117.01; 383/38; 206/541; 426/120
See application file for complete search history.

(56) References Cited

U.S. PATENT DOCUMENTS

| | | | | |
|---|---|---|---|---|
| 5,429,262 | A | 7/1995 | Sharkey | |
| 5,540,333 | A * | 7/1996 | Gonzalez et al. | 206/541 |
| 6,182,890 | B1 | 2/2001 | Sattler et al. | |
| 2006/0022024 | A1 * | 2/2006 | Krimsky et al. | 229/120.18 |
| 2006/0180644 | A1 | 8/2006 | Baker | |
| 2009/0208147 | A1 * | 8/2009 | Steele | 383/38 |

FOREIGN PATENT DOCUMENTS

WO 0170081 9/2001

OTHER PUBLICATIONS

International Search Report and Written Opinion for PCT application No. PCT/US2010/054435.

* cited by examiner

*Primary Examiner* — Fenn Mathew
*Assistant Examiner* — Elizabeth Volz
(74) *Attorney, Agent, or Firm* — Warner Norcross & Judd LLP

(57) ABSTRACT

A food and condiment container having a first storage space for a food item and a second storage space for a condiment. The container includes a paperboard carton and an appliqué fold-out pocket affixed thereto and moveable between open and closed positions for receiving a condiment The pocket includes a front panel, a back panel, and first and second side panels extending therebetween. The back panel is joined to the carton, and the front panel is joined to the back panel along a portion thereof to hinge forward from the back panel. The side panels are connected between the front and back panels and are collapsible along a crease extending the vertical length of the side panels. Prior to use, the appliqué pocket remains flush with the carton and is opened along a perforation line to form a storage space for a condiment.

4 Claims, 10 Drawing Sheets

FOOD AND CONDIMENT CONTAINER

The present invention relates to disposable food and condiment containers; more specifically, the present invention relates to disposable containers having a first storage space for a food item and a second storage space for a condiment.

So called "fast food" establishments typically serve prepared food in disposable packaging of one form or another. Such packaging can include sandwich wrappers, paperboard "side-item" containers, and plastic envelopes containing a condiment. Each style of packaging is tailored to enhance the portability of the corresponding food item, while also insulating the corresponding food item from contaminants and limiting the undesired transfer of heat through the selected packaging.

While widely accepted, existing paperboard containers for side-items such as french-fries, hash browns, onion rings or chicken strips have significant drawbacks, particularly for persons who frequently find themselves eating such food items in a vehicle. For example, a drive through customer will typically receive these food items in a disposable container formed of a single sheet of paperboard. In addition, the drive through customer will typically receive one or more condiment packets for use with the purchased food item. Condiment use is difficult at beset. The customer will typically resort to one of three unsatisfactory approaches, each limited by its inherent drawbacks. First, the customer might apply the condiment to the exposed area of food. However, in the case of ketchup and French fries or onion rings, it is typically difficult to pick up a fry or onion ring without grabbing a ketchup covered portion. Also, ketchup can cause the French fries or onion rings to become soggy when applied for more than a few seconds. Second, the customer might apply the ketchup to an available hand napkin, which in turn can be placed on an automobile dashboard or oversized arm rest. However, napkins are at least partially absorbent and will often allow ketchup to leak through to the underlying surface. In addition, the napkin, if not weighted down, can slide or overturn onto a finished surface of the automobile passenger compartment. Third, the customer can attempt to remove only the corner of each condiment packet and insert individual food items into the packet to apply ketchup thereto. However, this approach requires two hands, additional concentration over other methods, and additional time. In addition, this method is not a realistic solution for larger items such as onion rings and chicken strips.

SUMMARY OF THE INVENTION

The aforementioned problems are overcome by the present invention, which is directed to an improved container having a first storage space for a food item and a second storage space for a condiment. According to one embodiment, the container includes a paperboard carton and an appliqué fold-out pocket affixed thereto and moveable between open and closed positions for receiving a condiment. The appliqué pocket includes a front panel, a back panel, and first and second side panels extending therebetween. The back panel is joined to the paperboard carton, and the front panel is joined to the back panel along a portion thereof to hinge forward from the back panel to the open position. The side panels are connected between the front and back panels and are collapsible along a crease extending the vertical length of the side panels. Prior to use, the appliqué remains flush with the paperboard carton and is readily opened along a perforated separation line to form a pocket for receipt of a condiment.

In another embodiment, the container includes a base, an upwardly extending sidewall connectable to the base, and a pull-out panel integrally formed with the sidewall, the pull-out panel being moveable from a closed position flush with the sidewall to an open position for receiving a condiment. The pull-out panel is defined by a separation line in the sidewall and a hinge, the hinge being curved to stabilize the pull-out tab in the open position. The pull-out panel can be formed in an upper portion of the sidewall distal from the base, and can include a pull tab to facilitate detachment of the pull-out panel inward or outward from the sidewall along the separation line. When opened inwardly from the sidewall, the pull-out panel forms a channel defined by vertically opposed portions of the sidewall, with a first portion having a convex inner surface and the second portion having a corresponding concave inner surface for retaining a condiment therebetween.

In another embodiment of the invention, the container includes a base, an upwardly extending sidewall connectable to the base, and first and second weakened fold-lines extending laterally across the width of the sidewall and generally parallel to the base. The first, or lower, fold-line substantially coincides with the upper edge of adjacent sidewalls, and the second, or upper, fold-line is spaced apart from the first fold-line. The first fold-line is creased or stamped to bend inwardly, and the second fold-line is creased or stamped to bend outwardly. The upper portion of the sidewall is substantially "S" shaped when bent to an acute angle about the first and second fold-lines. As a result, the side panel defines a lateral, elongate condiment channel having first and second side panels diverging upwardly from the upper fold-line and approximately above the primary opening in the food container.

In another embodiment of the invention, a condiment container includes a condiment reservoir and an attachment arm or clip for attaching the condiment reservoir to a food container sidewall. The condiment reservoir includes a base and an upward extending sidewall that together define a storage space for a condiment. The attachment arm includes an outwardly extending portion and a downwardly extending portion. The downwardly extending portion extends approximately parallel to the condiment reservoir sidewall and is spaced apart from the condiment reservoir sidewall for receiving a food container sidewall therebetween. The downwardly extending portion includes a curved surface to generally conform to the corresponding food container sidewall, and is generally coextensive with the food container sidewall along its width. The downward extending portion terminates in a terminal edge and extends the vertical height of the condiment reservoir sidewall. The condiment container can include a detachable lid over the condiment container opening, the lid being adhesively secured to the condiment container and including a peel-away tab for easy removal.

Accordingly, the present invention provides improved food and condiment containers each having enhanced versatility over conventional paperboard cartons while facilitating the single-handed application of a condiment to a food item. The food and condiment containers of present invention can be manufactured with little or no added expense over existing paperboard cartons, in many instances with the addition of one or more perforation lines or fold-lines, to provides a low-cost, dual-purpose containers for prepared finger foods and condiments.

These and other features and advantages of the present invention will become apparent from the following description of the current embodiments and the accompanying drawings and appended claims.

DESCRIPTION OF THE CURRENT EMBODIMENTS

I. First Embodiment

Figure 1A:
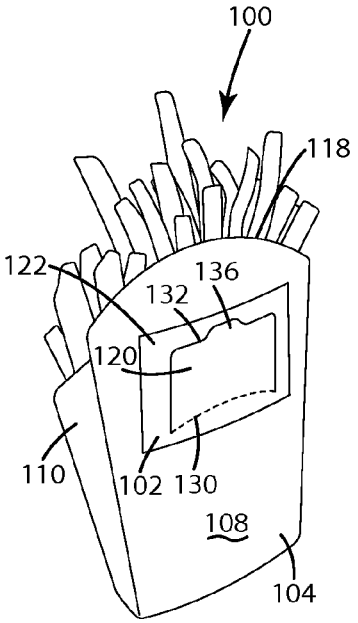
FIG. 1A is a perspective view of a food and condiment container according to a first embodiment of the present invention.
Figure 1B:
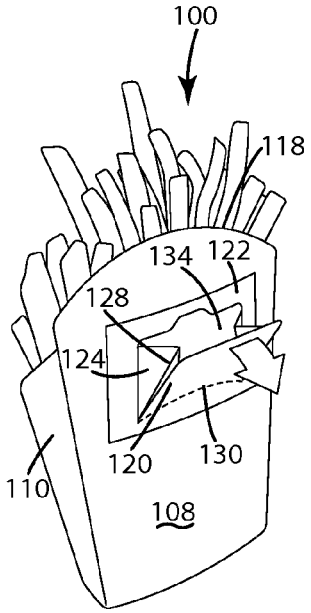
FIG. 1B is a perspective view of a partially open food and condiment container of FIG. 1A.
Figure 1C:
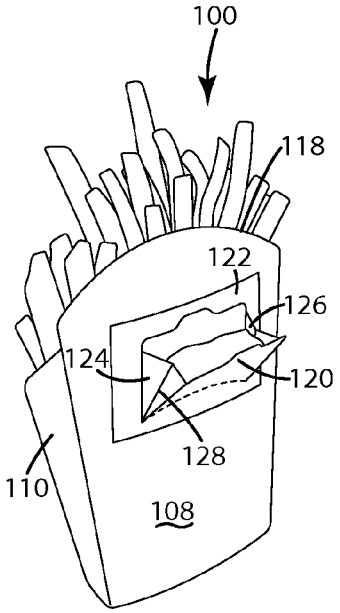
FIG. 1C is a perspective view of a completely open food and condiment container of FIG. 1A.

A food and condiment container in accordance with a first embodiment of the present invention is illustrated in FIGS. 1A-1C and generally designated 100. According to the present embodiment, an appliqué fold-out pocket (hereinafter appliqué) 102 is affixed to a sidewall of a paperboard carton 104 and moveable between open and closed positions for receiving a condiment.

More specifically, the food and condiment container 100 of the present embodiment includes a carton 104 having a front wall 106, a back wall 108, first and second sidewalls 110, 112, and a bottom wall 114. The front wall 106 and the back wall 108 are substantially vertically opposed to one another, and diverge slightly outwardly away from one another as they extend upwardly away from the bottom wall 114. In use, the front, back, side and bottom walls define a primary pocket for holding food items, the pocket being generally larger at the top portion than at the bottom portion thereof. In addition, the front wall 106 includes a concave upper edge 116, while the back wall 108 includes a corresponding convex upper edge 118 to facilitate the positioning of food items in the carton 104.

As also shown in FIGS. 1A-1C, the appliqué 102 includes a front panel 120, a back panel 122, and first and second side panels 124, 126. The back panel 122 is shown as being joined to the carton back wall 108, however the appliqué 102 and carton 104 can be joined, directly or indirectly, along any respective surfaces and in any suitable orientation. The side panels 124, 126 are connected between the front and back panels 120, 122, and are collapsible along a crease 128 extending the vertical length of the side panels. In the open position as shown in FIG. 1C, the side panels 124, 126 are generally V-shaped. A lateral, optionally curved bend-line 130 in the appliqué extends between the side panels 124, 126 to form a hinged connection between the front and back panels 120, 122, the crease 130 being optionally formed via a stamping process or other suitable method. In addition, the appliqué 102 can include one or more perforation lines 132 along the lateral and upper portions of the front panel 120. Prior to use, the appliqué 102 remains intact along the perforation line 132 and is easily opened along the perforation line 132 to facilitate movement of the appliqué 102 between the closed position (FIG. 1A) and the open position (FIG. 1C).

As noted above, the appliqué 102 and the carton 104 are formed of paperboard, but can alternatively be formed of any suitable material. The interior surfaces of the appliqué pocket can include an acetate membrane or a laminate coating to limit the transfer of grease or moisture therethrough. An additional layer 134 can be disposed between the front panel 120 and the back wall 108, the layer 134 also including an acetate membrane or laminate coating to prevent the transfer of grease or moisture therethrough. In addition, an adherent (not shown) can be utilized to retain the appliqué 102 to the carton 104 in any desired orientation.

In use, the appliqué 102 can be placed in the open position by first separating the front panel 120 from the back panel 122 along a separation line 132, optionally by use of a pull tab 136 extending upwardly from the front panel 120. As the user pulls on the front panel 120 away from the back panel 122, the side panels 124, 126 extend forward as shown in FIG. 1B, optionally flexing laterally outward to prevent the retraction of the front panel 120 toward the back panel 122. When the food and condiment container 100 is oriented vertically on a flat surface as shown in FIG. 1C, the food carton 104 pocket is positioned to receive the desired food item and the appliqué 102 is positioned to receive the desired condiment.

II. Second Embodiment

Figure 2A:
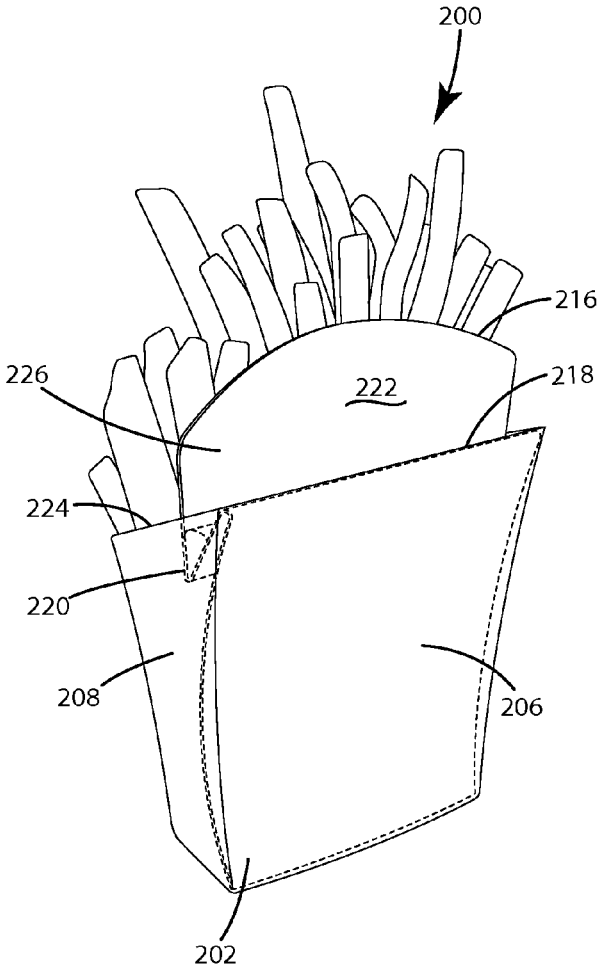
FIG. 2A is a perspective view of a food and condiment container according to a second embodiment of the present invention.
Figure 2B:
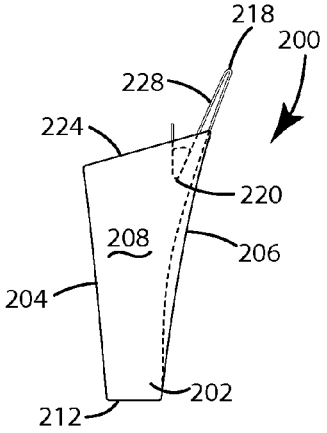
FIG. 2B is a side view of the food and condiment container of FIG. 2A.
Figure 2C:
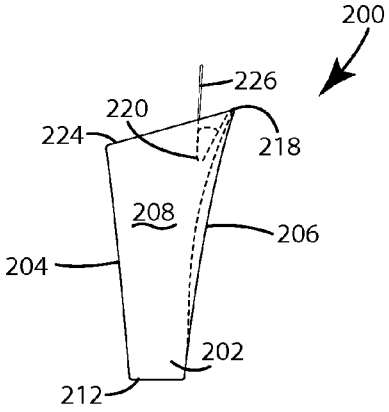
FIG. 2C is a side view of an alternative food and condiment container according to the second embodiment of the present invention.

A food and condiment container in accordance with a second embodiment of the present invention is illustrated in FIGS. 2A-2C and generally designated 200. According to the present embodiment, a food and condiment container includes a base, first and second upwardly extending sidewalls connectable to the base, and a third sidewall connectable to the base and including weakened bend-lines generally parallel to and distal from the base.

More specifically, the food and condiment container 200 of the present embodiment includes a carton 202 having a front wall 204, a back wall 206, first and second sidewalls 208, 210, and a base 212. The front wall 204 and the back wall 206 are vertically opposed to one another substantially as described above in connection with the first embodiment, and diverge slightly outwardly away from one another as they extend upwardly away from the base 212. In use, the front, back, side and bottom walls define a primary pocket for holding food items, the pocket being generally larger at the top portion than at the bottom portion thereof. In addition, the front wall 204 includes a concave upper edge 214, while the back wall 206 includes a corresponding convex upper edge 216 to facilitate the positioning of food items in the food and condiment container 200.

As also shown in FIGS. 2A-2C, the back wall 206 includes first and second weakened, optionally perforated, bend-lines 218, 220 extending laterally across its width and generally parallel to the base 212. The back wall 206 also includes an upper portion 222 extending upwardly beyond the adjacent side walls 208, 210. As shown in FIGS. 2A-2B, the first, or lower, bend-line 218 substantially coincides with the upper edge 224 of the first and second sidewalls 208, 210. As alternatively shown in FIG. 2C, however, the first, or lower, bend-line 218 can be spaced apart from the upper edge 224 of the first and second sidewalls 208, 210. In the above configurations, the first weakened bend-line 218 is creased or stamped to bend inwardly, or in a first direction, while the second weakened bend-line 220 is creased or stamped to bend outwardly, or in a second direction different from the first direction. Viewed from the side as shown in FIGS. 2B-2C, the back wall 206 is substantially "S" shaped when bent to an acute angle about the first and second bend-lines 218, 220. According to the present invention, the consumer typically receives the carton 202 with the back wall 206 in the fully extended upright position. When it is desirable to form a pocket or channel for a condiment, the user can bend the back wall 206 about the pre-weakened bend-lines 218, 220 to form a lateral, elongate channel having sidewalls 226, 228 diverging upwardly from the upper bend-line 220. In this position as shown in FIGS. 2A-2C, a lateral pocket or channel is formed in the carton back wall to receive the desired condiment. It should also be noted that the carton 202 can instead be pre-assembled as shown in FIGS. 2B-2C with the lateral pocket or channel in the back wall 206 or other surface, requiring no further manipulation by a user.

III. Third Embodiment

A food and condiment container in accordance with a third embodiment of the present invention is illustrated in FIGS. 3A-3D and generally designated 300. According to the present embodiment, a food and condiment container includes a base, an upwardly extending sidewall connectable to the base, and a pull-out panel integrally formed with the sidewall and moveable from a closed position to an open position for receiving a condiment.

More specifically, the food and condiment container 300 of the present embodiment includes a carton 302 having a front wall 304, a back wall 306, first and second sidewalls 308, 310, and a base 312. The front wall 304 and the back wall 306 are substantially vertically opposed to one another, and diverge slightly outwardly away from one another as they extend upwardly away from the base 312. In use, the front, back, side and bottom walls define a primary pocket 314 for holding food items, the pocket 314 being generally larger at the top portion than at the bottom portion thereof. In addition, the front wall 304 includes a concave upper edge 316, while the back wall 306 includes a corresponding convex upper edge 317 to facilitate the positioning of food items in the primary pocket 314.

Figure 3A:
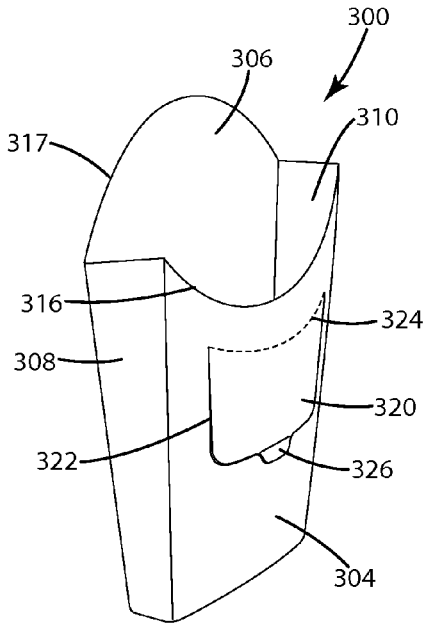
FIG. 3A is a perspective view of a food and condiment container according to a third embodiment of the present invention.
Figure 3B:
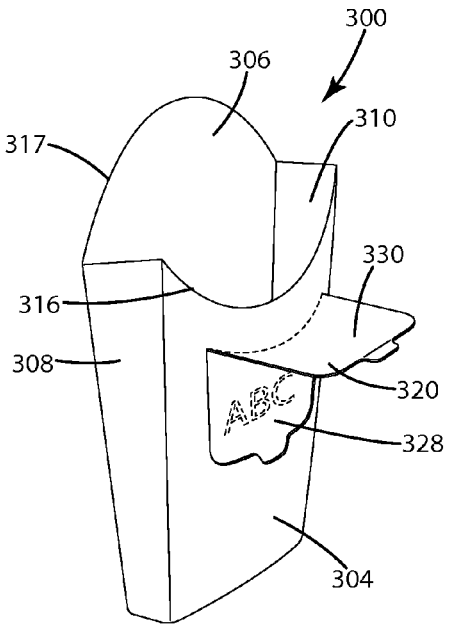
FIG. 3B is a perspective view of the food and condiment container of FIG. 3A illustrating a pull-out panel for receiving a condiment.
Figure 3C:
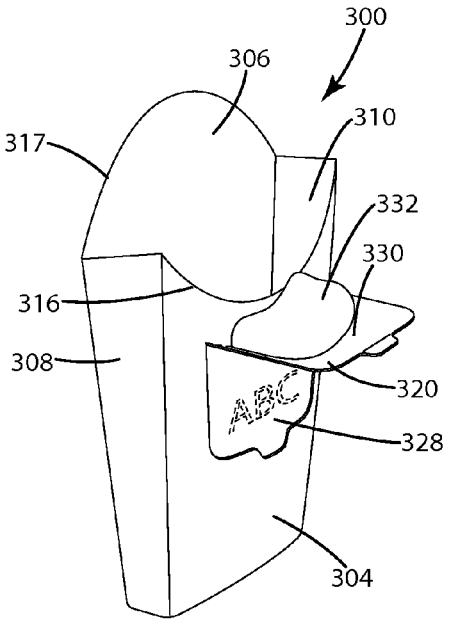
FIG. 3C is a perspective view of the food and condiment container of FIG. 3A illustrating a condiment on the pull-out panel.
Figure 3D:
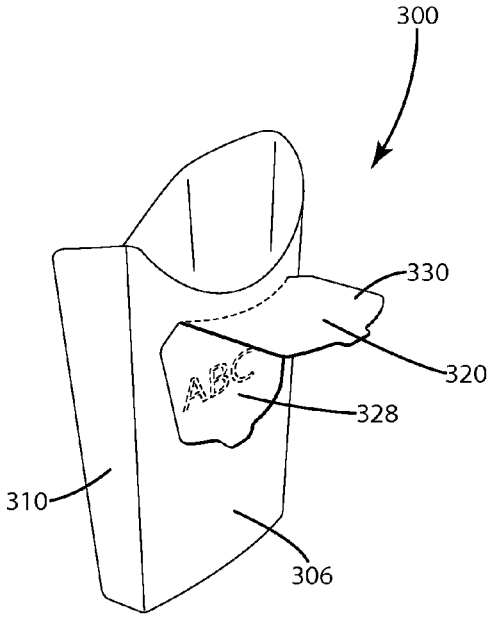
FIG. 3D is a perspective view of an alternative food and condiment container according to the third embodiment of the present invention.

As also shown in FIGS. 3A-3C, the front wall 304 includes a pull-out panel 320 defined by a separation line 322 and a bend-line 324. The bend-line 324 is generally "U" shaped and extends laterally across a substantial portion of the width of the front wall 304 to stabilize the pull-out panel 318 in the open position as shown in FIGS. 3B-3D. The pull-out panel 320 includes a pull tab 326 to facilitate detachment of the pull-out panel 320 from the front wall 304 along the separation line 322. In addition, the separation line 322 can be perforated or weakened according to any suitable method to define lateral edge portions and a top or bottom edge portion of the pull-out panel 320. Though shown as forming an integral part of the front wall 304 in FIGS. 3A-3C, the pull-out panel 320 can also or alternatively form an integral part of the back wall 306 as shown in FIG. 3D. In addition, the front wall 304 or back wall 306 can include a paperboard backing 328 behind the pull-out panel 320, such that the paperboard backing 328 (optionally including a logo or other visual indicia) is viewable to a user when the pull-out panel 320 is in the open position as shown in FIGS. 3B-3D. As illustrated, the paperboard backing 328 forms a semi-rigid barrier to prevent the loss of food items from the primary pocket 314 through what would otherwise be an opening in the front wall 304 (FIGS. 3A-3C) or back wall 306 (FIG. 3D).

In use, the pull-out panel 320 is placed in the open position by first separating the pull-out panel 320 from the corresponding front wall 304, back wall 306, or sidewall 308, 310 along the weakened or perforated separation line 320, optionally by use of a pull tab 326. As the user lifts the pull-out panel 320 past horizontal, the upwardly curved bend-line 324 stabilizes the pull-out panel 320 in the open position and promotes a concave, semi-rigid bowl-like upper surface 330. When the food and condiment container 100 is oriented vertically on a flat surface as shown in FIGS. 3C-3D, the primary pocket 314 can receive the desired food item, while the pull-out panel 320 can receive the desired condiment 332 on its upper surface 330.

IV. Fourth Embodiment

A food and condiment container in accordance with a fourth embodiment of the present invention is illustrated in FIGS. 4A-4E and generally designated 400. The fourth embodiment is structurally and functionally similar to the third embodiment described above, with the further modification that the bend-line 424 is downwardly curved (i.e., an inverted "U" shaped), and the pull-out panel folds inwardly over the primary pocket. The remaining elements of the food and condiment container 400 are identified by the same designating numerals as the corresponding element in the third embodiment, with the exception that the numerals begin with a 4.

Figure 4A:
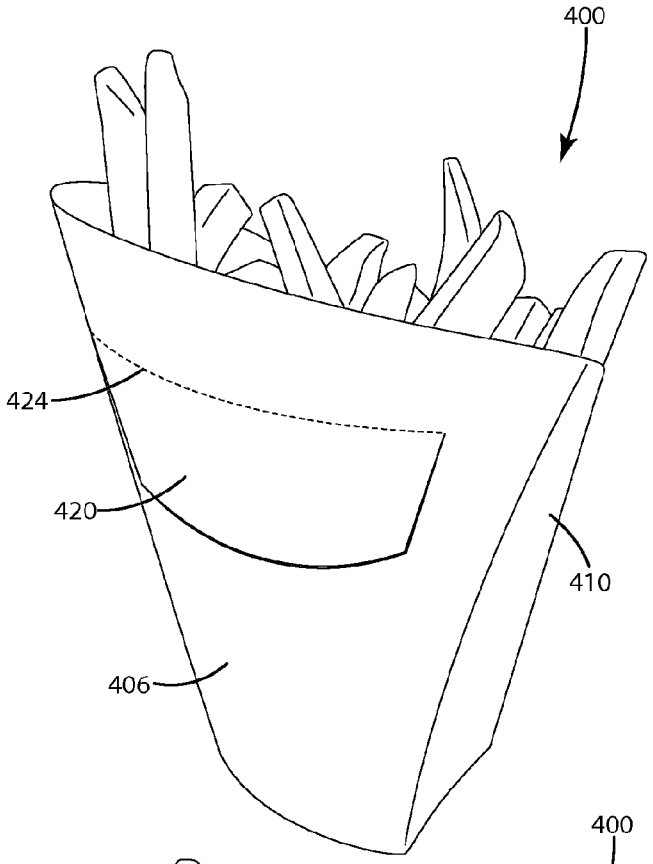
FIG. 4A is a rear perspective view of a food and condiment container according to a fourth embodiment of the present invention.
Figure 4B:
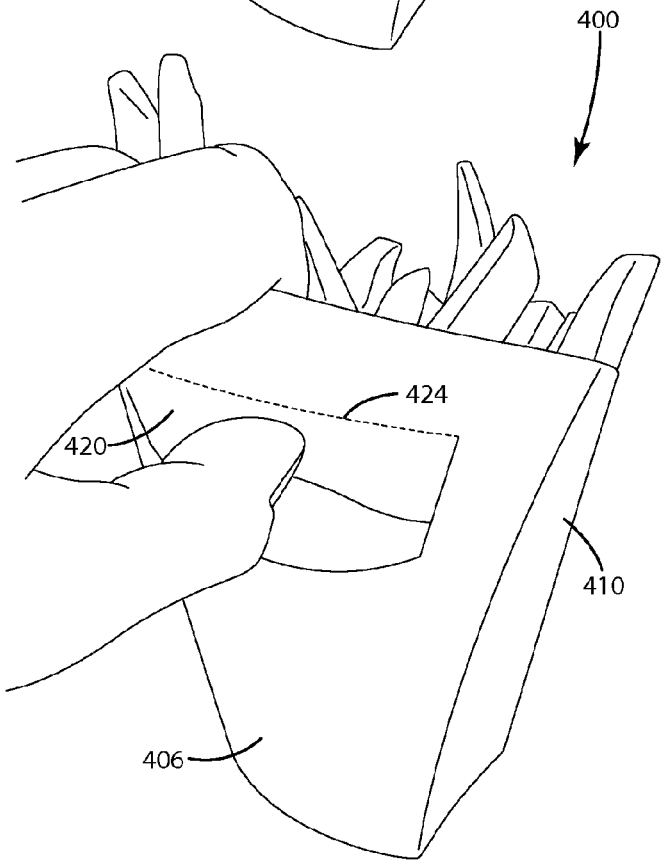
FIG. 4B is a rear perspective view of the food and condiment container of FIG. 4A illustrating a fold-in panel for receiving a condiment.
Figure 4C:
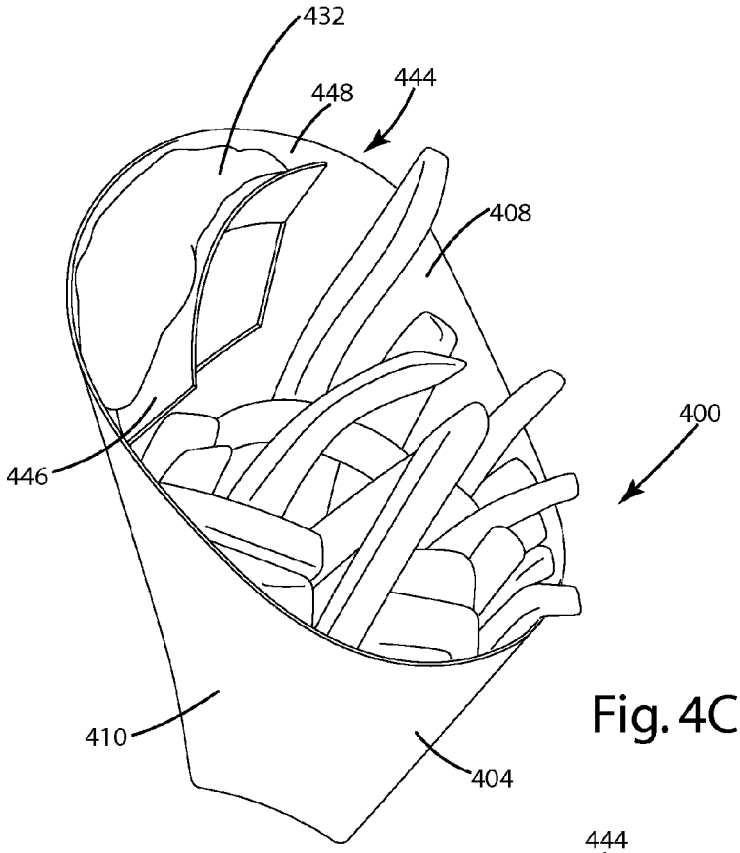
FIG. 4C is a front perspective view of the food and condiment container of FIG. 4A illustrating a condiment on the fold-in panel.
Figure 4D:
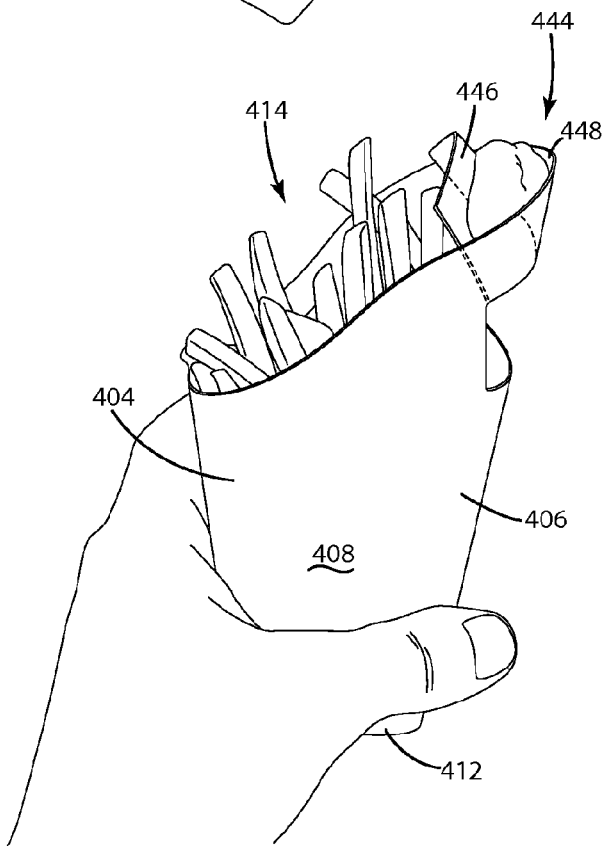
FIG. 4D is a side view of the food and condiment container of FIG. 4A illustrating a condiment on the fold-in panel.
Figure 4E:
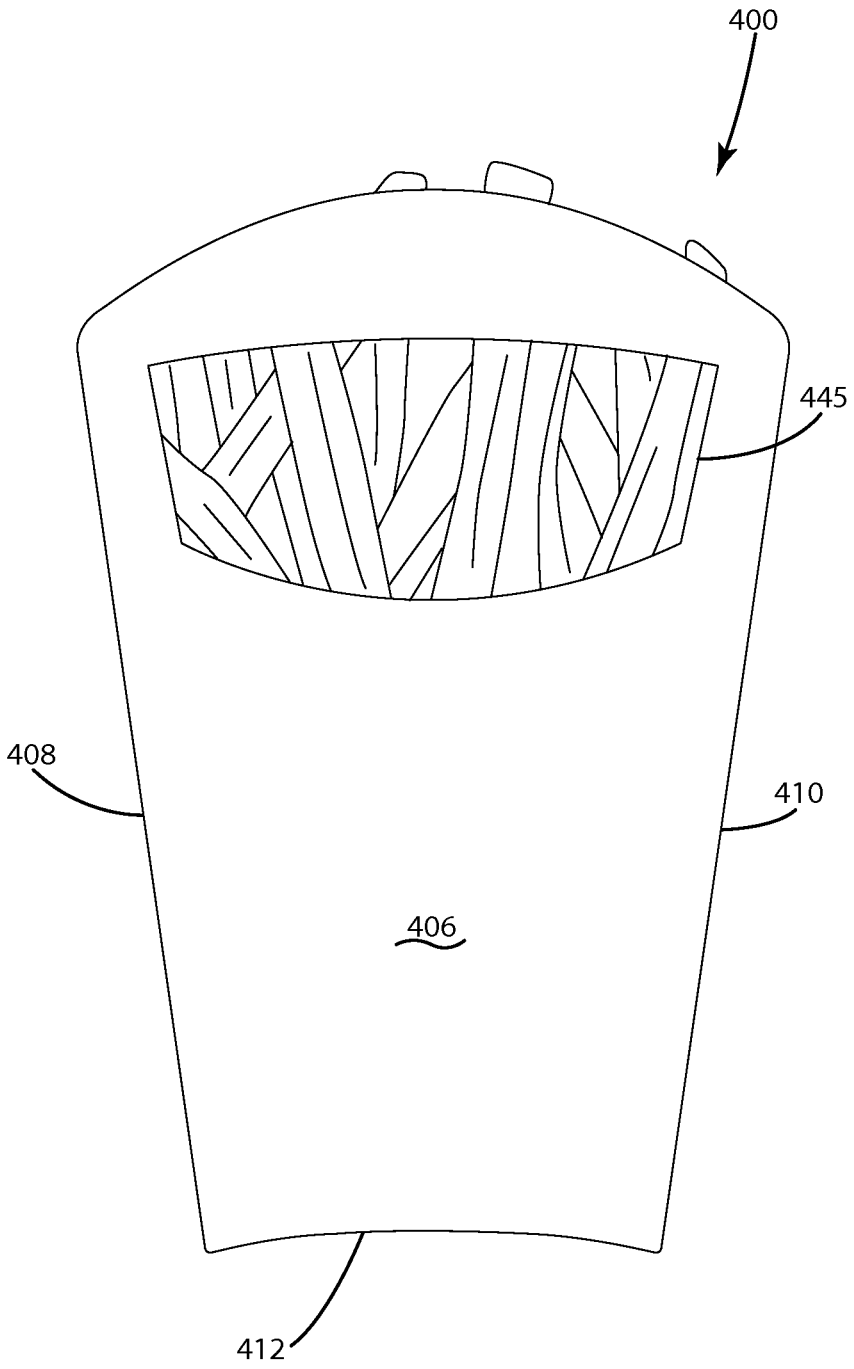
FIG. 4E is a rear view of the food and condiment container of FIG. 4A.

More specifically, the pull-out panel 420 is formed in an upper portion 422 of the back wall 406 distal from the base 412 to prevent the escape of food through the opening 445 in the back wall 406, and to provide an elongated channel 444 for a condiment near the opening in the primary pocket 414. The convex curvature of the back wall outer surface 406 and the inverted "U" shaped bend-line 424 cooperate to keep the pull-out tab 420 from bending out of the open configuration shown in FIGS. 4C-4E. As also shown in FIGS. 4C-4E, the channel 444 is defined by vertically opposed portions of the back wall 406, with a first portion having a convex inner surface 446 and the second portion having a corresponding concave inner surface 448 for retaining a condiment 432 therebetween. The present embodiment therefore has the added advantage of being formed from a unitary piece of stock paperboard (e.g., not requiring a paperboard backing in the aperture formed by the pull-out panel 420), while at the same time lessening the risk that a condiment 432 or other substance will escape the container 400 in response to a failure in the pull-out panel 420.

V. Fifth Embodiment

A food and condiment container in accordance with a fifth embodiment of the present invention is illustrated in FIGS. 5A-5D and generally designated 500. The fifth embodiment is structurally and functionally similar to the third embodiment described above, with the further modification that the pull-out panel opens inwardly from a sidewall of the carton 502 to form a pocket for receiving a condiment 532. The remaining elements of the food and condiment container 500 are identified by the same designating numerals as the corresponding element in the third embodiment, with the exception that the numerals begin with a 5.

Figure 5A:
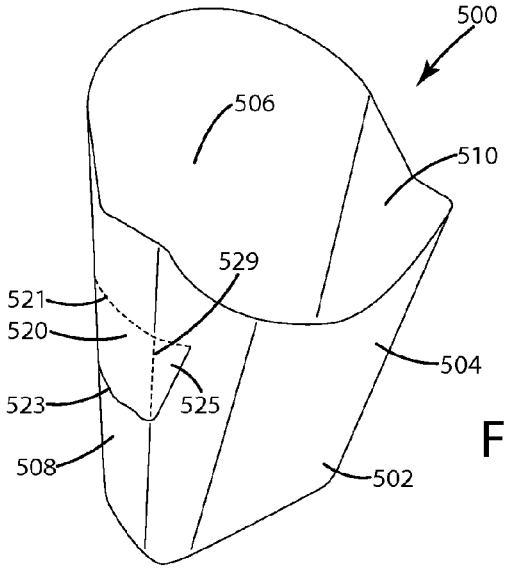
FIG. 5A is a perspective view of a food and condiment container according to a fifth embodiment of the present invention.
Figure 5B:
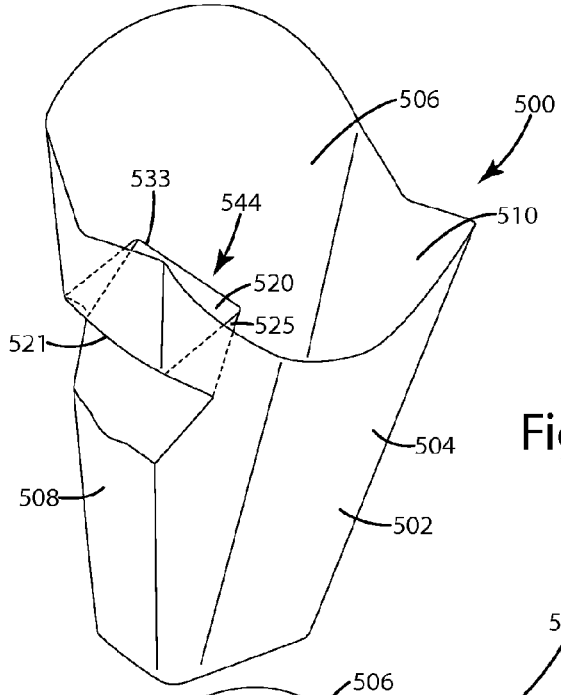
FIG. 5B is a perspective view of the food and condiment container of FIG. 5A illustrating a fold-in panel for receiving a condiment.
Figure 5C:
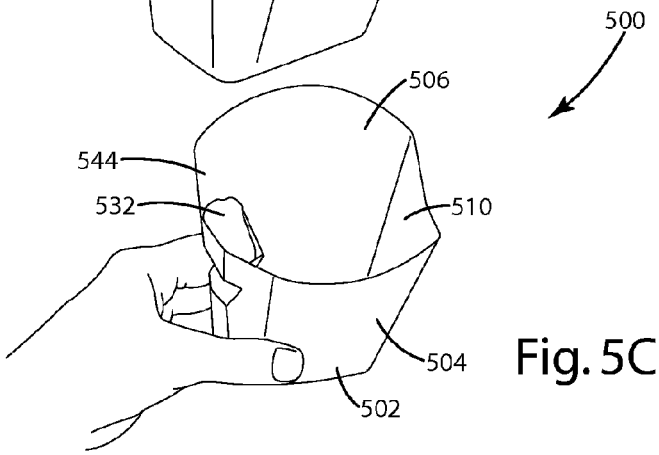
FIG. 5C is a perspective view of the food and condiment container of FIG. 5A illustrating a condiment on the fold-in panel.
Figure 5D:
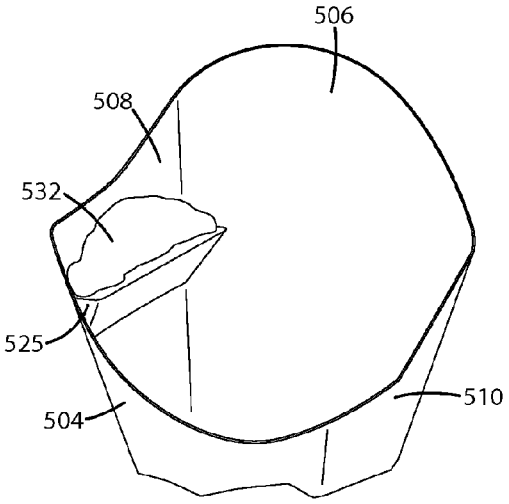
FIG. 5D is a perspective view of the food and condiment container of FIG. 5A illustrating a condiment on the fold-in panel.

More specifically, the food and condiment container 500 of the present embodiment includes a pocket 544 formed at an upper portion of a sidewall 508, the pocket 544 being moveable between a closed position generally flush with the sidewall 508 and an open position spaced apart from the sidewall 508 to receive a condiment 532. The pocket 544 includes a primary panel 520 defined by a fold-line 521 extending laterally along the width of the side wall 508 and a separation line 523 spaced apart from and below the fold-line 521. The separation line 523 continues upwardly in the adjacent front and back walls 504, 506, and the fold-line 521 continues laterally along a portion of the adjacent front and back walls 504, 506 until it joins the upwardly angled separation line 523. The primary panel 520 is hinged to adjacent support panels 525, 527 along the lateral portions of the primary panel 520 (i.e., along first and second fold-lines 529, 531). The panel 520 opens inwardly as shown in FIG. 5B to provide a pocket for receiving a condiment 532, and in this open position the primary panel upper edge 533 is spaced apart from the side wall 508.

VI. Sixth Embodiment

Figure 6:
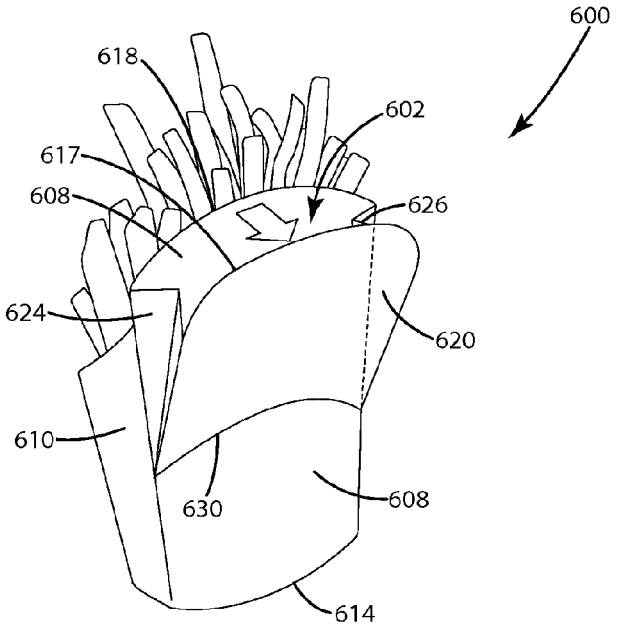
FIG. 6 is a perspective view of a food and condiment container according to a sixth embodiment of the present invention.

A food and condiment container in accordance with a sixth embodiment of the present invention is illustrated in FIG. 6 and generally designated 600. The sixth embodiment is structurally and functionally similar to the first embodiment described above, with the further modification that the fold-out pocket is coextensive with a substantial portion of the back wall. The remaining elements of the food and condiment container 600 are identified by the same designating numerals as the corresponding element in the first embodiment, with the exception that the numerals begin with a 6.

More specifically, the food and condiment container 600 of the present embodiment includes a pocket 602 coextensive with an upper portion of the back wall 608, the pocket 602 being moveable between a closed position generally flush with the back wall 608 and an open position spaced apart from the back wall 608. A primary panel 620 is defined by a fold-line 630 extending laterally along the width of the back wall 608. First and second side panels 624, 626 are connected between the back wall 608 and the primary panel 620, and are collapsible in an accordion-like manner along a vertical crease 628 in each side panel. In the open position as shown in FIG. 6, the side panels 624, 626 are generally V-shaped. The lateral, optionally arcuate, fold-line 630 extends between the side panels 624, 626, the fold-line 630 being optionally formed via a stamping process or other suitable method.

As noted above, the primary panel 620 can be coextensive with the back wall 608 in at least one dimension and can terminate at an upper edge 617 adjacent the upper arcuate edge 618 of the back wall 608. In use, the pocket 602 can be placed in the open position by first separating the upper portion of the primary panel 620 from the back wall 608. As the primary panel 620 retracts from the back wall 608 about the fold-line 630, the side panels 624, 626 extend forward as shown in FIG. 6, optionally flexing or bowing laterally outward to prevent the retraction of the primary panel 620 toward the back wall 608. When the food and condiment container 600 is oriented vertically on a flat surface and in the open configuration, the back wall 608 forms a bather between food and condiment. The available condiment pocket volume can be increased or decreased by lowering or raising the fold-line 630, respectively.

VII. Seventh Embodiment

Figure 7:
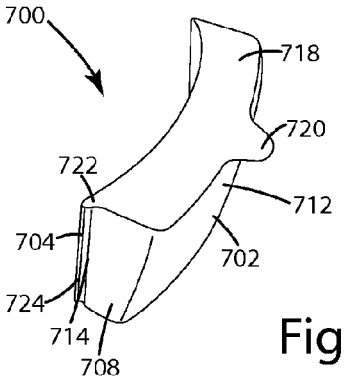
FIG. 7 is a side perspective view of a food and condiment container according to a seventh embodiment of the present invention.

A condiment container in accordance with a seventh embodiment of the present invention is illustrated in FIG. 7 and generally designated 700. According to the present embodiment, the condiment container includes a reservoir 702 for storing a condiment and an attachment arm or "clip" 704 for attaching the condiment reservoir 702 to a sidewall of a food container (not shown).

More specifically, the condiment reservoir 702 includes a base 706, first and second sidewalls 708, 710, a front wall 712, and a back wall 714 that together define a storage space for a condiment. The front wall 712 and the back wall 714 are substantially vertically opposed to one another. In like manner, the sidewalls 708, 710 are substantially vertically opposed to one another. The back wall outer surface is concave to conform to a corresponding food container surface, and is generally coextensive with the food container surface along its width. The front wall outer surface is generally convex, and the front, back and sidewalls terminate in a periphery or lip 716 defining an opening for access to the storage space. The reservoir 702 optionally includes a detachable lid 718 over the condiment reservoir opening, the lid 718 being adhesively secured to the condiment reservoir lip 716 and including a peel-away tab 720 for easy removal of the lid 716.

The attachment arm 704 is joined to the condiment reservoir back wall 714 or perimeter lip 716 and includes an outwardly extending portion 722 and a downwardly extending portion 724. The downwardly extending portion 724 extends approximately parallel to the condiment reservoir back wall 714, and is spaced apart from the condiment reservoir back wall 714 for receiving a food container sidewall therebetween. The downwardly extending portion 724 can include a curved surface to generally conform to the corresponding food reservoir sidewall, and is generally coextensive with the food reservoir sidewall along its width. The downward extending portion 724 terminates in a terminal edge and extends the vertical height of the condiment reservoir back wall 714.

In use, the condiment container 700 can be placed over a sidewall of a corresponding food container. For example, the condiment container 700 can telescopically receive the upwardly extending front or back wall of a food carton, the front or back wall being disposed between the condiment container downward extending arm portion 724 and the condiment reservoir back wall 714. The condiment container 700 is typically formed of a semi-rigid or rigid material, and can include paperboard or a molded polymeric material. The condiment container 700 can be pre-packaged with a condiment, or can be used in combination with condiment tear packages or pump actuated condiment dispensers known in the art.

Though described above as including an attachment arm or clip 704 for attaching the condiment reservoir 702 to a sidewall of a food container, the condiment container 700 can alternatively include an adherent to join the condiment reservoir 702 to a sidewall of a food container. For example, the condiment container 700 can include a peel-and-stick pressure sensitive adhesive affixed thereto. A user can simply remove a release liner from the pressure sensitive adhesive before bonding the condiment reservoir 702 to a surface of a corresponding food container. In substantially the same manner as described above, the condiment container 700 can be pre-packaged with a condiment, or can be used in combination with condiment tear packages or pump actuated condiment dispensers.

VIII. Eighth Embodiment

Figure 8A:
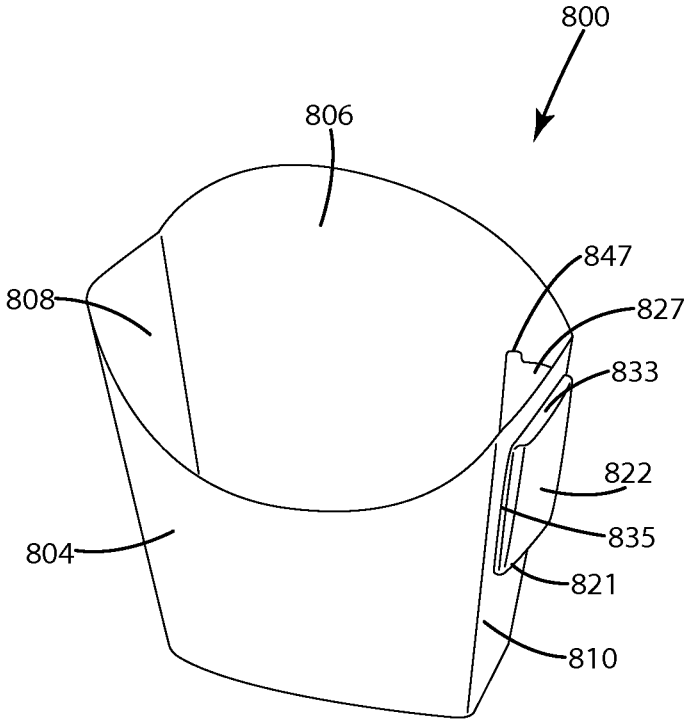
FIG. 8A is a front perspective view of a food and condiment container according to an eighth embodiment of the present invention.
Figure 8B:
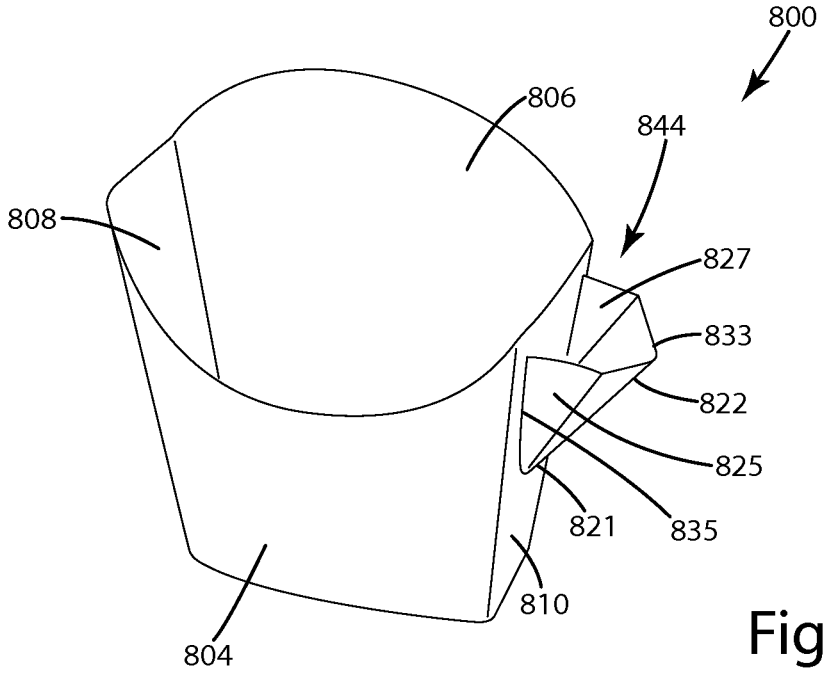
FIG. 8B is a front perspective view of the food and condiment container of FIG. 8A illustrating a pull-out pocket for receiving a condiment.

A food and condiment container in accordance with an eighth embodiment of the present invention is illustrated in FIGS. 8A-8B and generally designated 800. The eighth embodiment is structurally and functionally similar to the fifth embodiment described above, with the further modification that the fold-out pocket includes a primary panel separate from the sidewall and opening outwardly therefrom. The remaining elements of the food and condiment container 800 are identified by the same designating numerals as the corresponding element in the fifth embodiment, with the exception that the numerals begin with a 8.

More specifically, the food and condiment container 800 of the present embodiment includes a semi-rigid or rigid paperboard pocket 844 formed at an upper portion of a sidewall 810, the pocket 844 being moveable between a closed position generally flush with the sidewall 810 and an open position spaced apart from the sidewall 810 to receive a condiment 832. The pocket 844 includes a primary panel 822 separate from the sidewall 810 and generally coextensive therewith along its width. The primary panel 822 is supported by first and second side panels 825, 827 extending generally perpendicular to the primary panel 822 and through corresponding vertical slits 835, 837 in the food container sidewall 810. The first and second side panels 825, 827 each include an upward extending tab 845, 847 to prevent over rotation of the primary panel 822 about its hinge 821. In addition, the first and second side panels 825, 837 are generally flush with the front wall 804 and the back wall 806 of the food container, respectively. The primary panel 822 opens outwardly as shown in FIG. 8B to provide a pocket 844 for receiving a condiment 832, and in this open position the primary panel upper edge 833 is spaced apart from the side wall 810.

IX. Ninth Embodiment

A food and condiment container in accordance with a ninth embodiment of the present invention is illustrated in FIGS. 9A-9D and generally designated 900. The ninth embodiment is structurally and functionally similar to the third embodiment described above, with the further modification that the fold-out panel includes a removable center to form an opening for supportably receiving a standard half ounce condiment cup. The remaining elements of the food and condiment container 900 are identified by the same designating numerals as the corresponding element in the third embodiment, with the exception that the numerals begin with a 9.

Figure 9A:
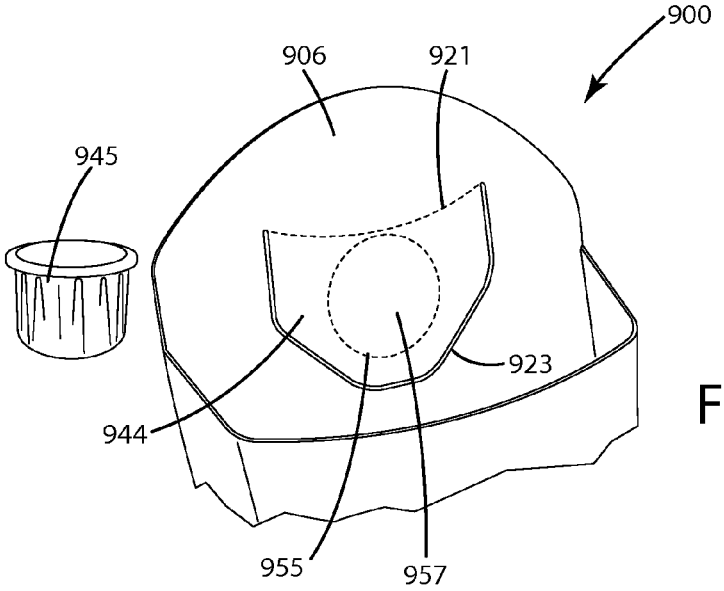
FIG. 9A is partially exploded view of a food and condiment container according to a ninth embodiment of the present invention.
Figure 9B:
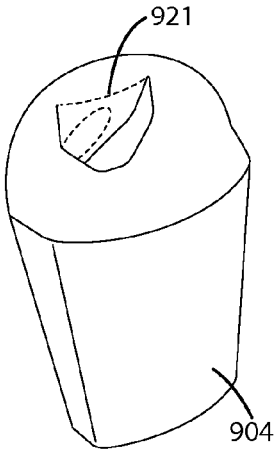
FIG. 9B is a front perspective view of the food and condiment container of FIG. 9A.
Figure 9C:
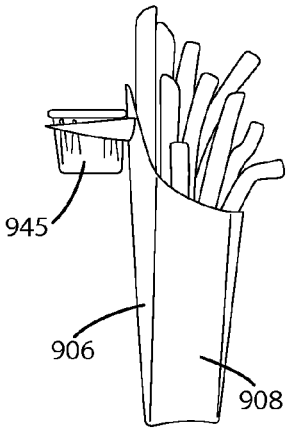
FIG. 9C is a side view of the food and condiment container of FIG. 9A.
Figure 9D:
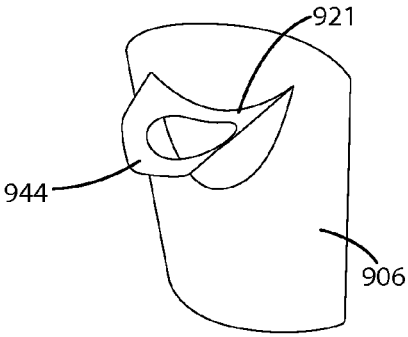
FIG. 9D is a rear perspective view of the back wall and the fold-out panel of the food and condiment container of FIG. 9A.

More specifically, the food and condiment container 900 of the present embodiment includes a fold-out paperboard panel 944 moveable between a closed position generally flush with the back wall 906 and an open position for receiving a condiment cup 945. The fold-out panel 944 is defined by a curved bend-line 921 and a perforated or scored separation line 923. The bend-line 921 extends laterally along a portion of the upper back wall 906, and the separation line 923 begins at the left-most portion of the bend-line 921 and terminates at the right-most portion of the bend line 921. The fold-out panel 944 further includes an internal separation line 955, the internal separation line 955 defining a punch-through center tab 957 in the interior of the fold-out panel 944. Once the punch-through center tab 957 is removed, the internal separation line 955 defines a circular opening dimensioned to supportably receive a conventional one-half ounce condiment cup 945. An exaggerated upward "U" shaped curve in the fold-line 921 operates to resist the downward deflection of the panel 944 under the combined weight of the panel 944, the condiment cup 945, and any condiment 932. In addition, the opening can include a diameter less than the corresponding diameter of the condiment cup lip to retain the condiment cup in the panel opening. Accordingly, when the food and condiment container 900 is oriented vertically on a flat surface as shown in FIG. 9C, the primary pocket 914 can receive the desired food item, while the pull-out panel 944 can supportably receive the desired condiment cup.

The above description is that of current embodiments of the invention. Various alterations and changes can be made without departing from the spirit and broader aspects of the invention as defined in the appended claims, which are to be interpreted in accordance with the principles of patent law including the doctrine of equivalents. Any reference to elements in the singular, for example, using the articles "a," "an," "the," or "said," is not to be construed as limiting the element to the singular.

The invention claimed is:

1. A food and condiment container comprising:

a receptacle including an upward extending sidewall defining a storage space; and a condiment receiver joined to and separate from the sidewall and moveable between a closed position generally flush with the sidewall and an open position for receiving a condiment, the condiment receiver including:

a front panel hinging downwardly about a bend line from the closed position to the open position, and a back panel extending laterally outwardly from the front panel in the closed position, wherein the front panel and the sidewall define a pocket for receiving the condiment in the open position, wherein the front panel is joined to the back panel along the bend line to hinge forward from the back panel, wherein the condiment receiver includes first and second side panels, each of the first and second side panels being connected between the front panel and the back panel.

2. The food and condiment container of claim 1 further including an adherent between the sidewall and the back panel.

3. The food and condiment container of claim 1 wherein the first and second sidewalls each include a crease, the first and second sidewalls being collapsible along the crease when the condiment receiver is in the closed position.

4. The food and condiment container of claim 1 wherein the bend line is upwardly curved.

* * * * *

UNITED STATES PATENT AND TRADEMARK OFFICE

CERTIFICATE OF CORRECTION

PATENT NO. : 8,960,478 B2
APPLICATION NO. : 13/504216
DATED : February 24, 2015
INVENTOR(S) : Caleb C. Crye It is certified that error appears in the above-identified patent and that said Letters Patent is hereby corrected as shown below:

In The Specification

Column 8, line 44, "The back wall 608 forms a bather between food" should be --the back wall 608 forms a barrier between food--.

Signed and Sealed this
Twenty-second Day of March, 2016

Michelle K. Lee

Michelle K. Lee
*Director of the United States Patent and Trademark Office*